US007438384B2

(12) United States Patent
Byun et al.

(10) Patent No.: US 7,438,384 B2
(45) Date of Patent: Oct. 21, 2008

(54) DEVICE FOR WASHING AN INKJET HEAD AND AN INKJET PRINTING SYSTEM WITH THE SAME

(75) Inventors: Young Sang Byun, Goyang-si (KR); Hyun Ho Song, Goyang-si (KR); Young Phil Bang, Seoul (KR); Chun Gi Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 427 days.

(21) Appl. No.: 11/312,468

(22) Filed: Dec. 21, 2005

(65) Prior Publication Data

US 2006/0284924 A1 Dec. 21, 2006

(30) Foreign Application Priority Data

Jun. 20, 2005 (KR) ..... 10-2005-0053148

(51) Int. Cl.
*B41J 2/165* (2006.01)

(52) U.S. Cl. ..... 347/33; 347/28

(58) Field of Classification Search ..... 347/28, 347/29, 33, 20, 10

See application file for complete search history.

(56) References Cited

U.S. PATENT DOCUMENTS 5,103,244 A * 4/1992 Gast et al. ..... 347/33
6,238,035 B1 * 5/2001 Barinaga ..... 347/28

FOREIGN PATENT DOCUMENTS

JP 405104733 A * 4/1993 ..... 347/33

* cited by examiner

*Primary Examiner*—Shih-Wen Hsieh
(74) *Attorney, Agent, or Firm*—McKenna Long & Aldridge LLP

(57) ABSTRACT

A device for washing an inkjet head and an inkjet printing system having the same is provided. The device includes a bath which holds a washing solution and a wiping device disposed above the bath. The wiping device has a holding portion and an elastic wiper coupled with the holding portion. The elastic wiper is movable with respect to the holding portion, thereby permitting easy removal of alignment material from a nozzle on the inkjet head and cleaning of the elastic wiper.

16 Claims, 8 Drawing Sheets

DEVICE FOR WASHING AN INKJET HEAD AND AN INKJET PRINTING SYSTEM WITH THE SAME

CROSS-REFERENCE TO RELATED APPLICATION

This application claims the benefit of Korean Application No. P2005-53148 filed on Jun. 20, 2005, which is hereby incorporated by reference as if fully set forth herein.

BACKGROUND OF THE INVENTION

1. Field of the Invention

The present invention relates to devices for fabricating liquid crystal display devices, and more particularly, to an inkjet printing device which forms an alignment film and the like of a liquid crystal display device.

2. Discussion of the Related Art

Super thin flat panel display devices, such as liquid crystal display devices which have a display screen thickness of a few centimeters, are used in a variety of applications including notebook computers, monitors, spacecrafts, airplanes. These flat panel display devices have low power consumption due to a low operating voltage and are portable, thus making them an attractive option for the above-mentioned applications.

In general, a liquid crystal display device includes a lower substrate and an upper substrate opposite the lower substrate where a predetermined gap separates the two and a liquid crystal layer formed between the two substrates. The liquid crystal layer changes an orientation of liquid crystals in the liquid crystal layer depending on a voltage applied thereto, thereby changing a transmittivity of light which enables image reproduction.

Since a desired image cannot be obtained if the liquid crystals in the liquid crystal layer do not properly orientate when a voltage is applied, an alignment film is formed on each of the lower substrate and the upper substrate which maintains an initial arrangement of the liquid crystals.

A rubbing alignment method or an optical alignment method may be used to form an alignment film.

In the rubbing alignment method, a thin film of alignment material is coated on a substrate, and a rubbing roll having a rubbing cloth wound thereon is rotated on the thin film, thereby arranging the alignment material on the thin film in one direction.

In the optical alignment method, a thin film of alignment material is coated on a substrate, a polarized or non-polarized UV beam is then directed onto the thin film of the alignment material. When the UV beam is directed onto the thin film, the alignment material reacts to the UV beam thereby arranging the alignment material in the thin film in one direction.

In order to obtain the alignment film arranged in one direction by applying the rubbing alignment or the optical alignment, a thin coat of the alignment material is uniformly applied on the substrate.

A related art method for coating an alignment material on a substrate will be described with reference to the attached drawings.

FIG. 1 illustrates a section showing a method for coating an alignment film by using a related art roll printing device.

The related art roll printing device contains a substrate stage 12 for supporting a substrate 10, and a dispenser 14 for supplying alignment material. The roll printing device includes a doctor roll 16, anilox roll 18, and a printing roll 20.

The doctor roll 16 engages with the anilox roll 18 and the anilox roll 18 engages with the printing roll 20.

The printing roll 20 has a rubber plate 22 attached thereto suitable for printing a desired pattern of the alignment material.

A method for coating the alignment film using above roll printing device will be described. At first, alignment material 15 is dispensed between the doctor roll 16 and the anilox roll 18 with the dispenser 14. In this instance, because the doctor roll 16, the anilox roll 18, and the printing roll 20 are engaged with each other and rotate as shown in FIG. 1, the alignment material 15, supplied between the doctor roll 16 and the anilox roll 18, is evenly coated on the rubber plate 22 on the printing roll 20 by the anilox roll 18.

In the meantime, the substrate stage 12, having the substrate 10 placed thereon, moves in one direction under the printing roll 20. During the movement of the substrate stage 12, the substrate 10 on the substrate stage 12 and the rubber plate 22 on the printing roll 20 contact each other, such that the alignment material is transferred from the rubber plate 22 to the substrate 10, thereby coating the alignment material on the substrate 10.

However, the coating of the alignment material on the substrate by using such a roll printing device has the following drawbacks.

First, the sizes of the three rolls must be changed when a model size of the liquid crystal display device changes.

Second, for applications having a larger substrate which require a larger printing roll, it becomes more difficult to evenly coat alignment material on the entire surface of the substrate.

Third, use of the roll printing device wastes a fair amount of alignment material, thereby increasing production costs associated with coating a substrate using the related art roll printing device.

In response to these problems, an inkjet printing device has been used. A related art inkjet printing device, provided with an inkjet head having a plurality of nozzles for dispensing alignment material, dispenses the alignment material selectively from the plurality of nozzles. The related art inkjet printing device includes the flexibility of coating a variety of liquid crystal display devices having different sizes.

However, the related art inkjet printing device does not evenly coat alignment material when a portion of the alignment material is not fully discharged from the nozzle, but instead stays on the nozzle. In this instance, the nozzle may become clogged if a portion of the alignment material remaining on the nozzle sets.

SUMMARY OF THE INVENTION

Accordingly, the present invention is directed to a device for washing an inkjet head, and an inkjet printing system with the same that substantially obviates one or more problems due to limitations and disadvantages of the related art.

An advantage of the present invention is providing a device for washing an inkjet head for removing alignment material from a nozzle of an inkjet head.

Another advantage of the present invention is providing an inkjet printing system with the device for washing an inkjet head.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these advantages and in accordance with the purpose of the invention, as embodied and broadly described herein, a device for washing an inkjet head is disclosed. The device includes a bath which holds a washing solution and a wiping device disposed above the bath. The wiping device has a holding portion and an elastic wiper held at the holding portion Thus, the present invention removes alignment material or the like from a nozzle of an inkjet head by using a wiping device having an elastic wiper held at a holding portion.

In accordance with an embodiment of the present invention, the wiping device rotates relative to the holding portion. Thus, after removing material or the like from a nozzle of the inkjet head, the wiper swings into an underlying bath, such that the washing solution in the bath cleans the wiper.

Moreover, the device may include a bar in the bath where the wiper contacts the bar during cleaning, thereby improving the washing capability of the wiping device.

The wiper may be formed of rubber. In addition, a plurality of wipers may be held at the holding portion, thus increasing the ability to remove material or the like from a nozzle.

The wiper and the holding portion may be secured to each other with a bracket.

In another aspect of the present invention, an inkjet printing system is disclosed. The inkjet printing system includes a substrate stage which supports a substrate and a supply tank which holds a material. The inkjet printing system also has a head for discharging the material, a pipe connected between the supply tank and the head, and a washing device. The washing device includes a bath which holds washing solution and a wiping device positioned above the bath. The wiping device includes a holding portion and an elastic wiper held at the holding portion.

In one embodiment, the substrate stage or the head is movable in a predetermined direction.

The head includes a head body and a supply pipe in the head body which allows passage of the material through the head body. The head also has a nozzle connected to a predetermined portion of the supply pipe for discharging the predetermined material from the head and a discharger which moves the predetermined material into the nozzle, and discharges the predetermined material from the head.

The discharger may include a piezoelectric transducer formed opposite the nozzle with respect to the supply pipe, and a voltage applying device connected to the piezoelectric transducer which applies a voltage to the piezoelectric transducer. However, the discharger is not limited to this.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Reference will now be made in detail to an embodiment of the present invention, example of which is illustrated in the accompanying drawings.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents. Wherever possible, the same reference numbers will be used throughout the drawings to refer to the same or like parts.

A Device for Washing and Inkjet Head

FIRST EMBODIMENT

A device for washing an inkjet head will be described with reference to FIG. 2. Thereafter, a wiping device assembly in the device for washing an inkjet head will be described in more detail with reference to FIG. 3.

Figure 1:
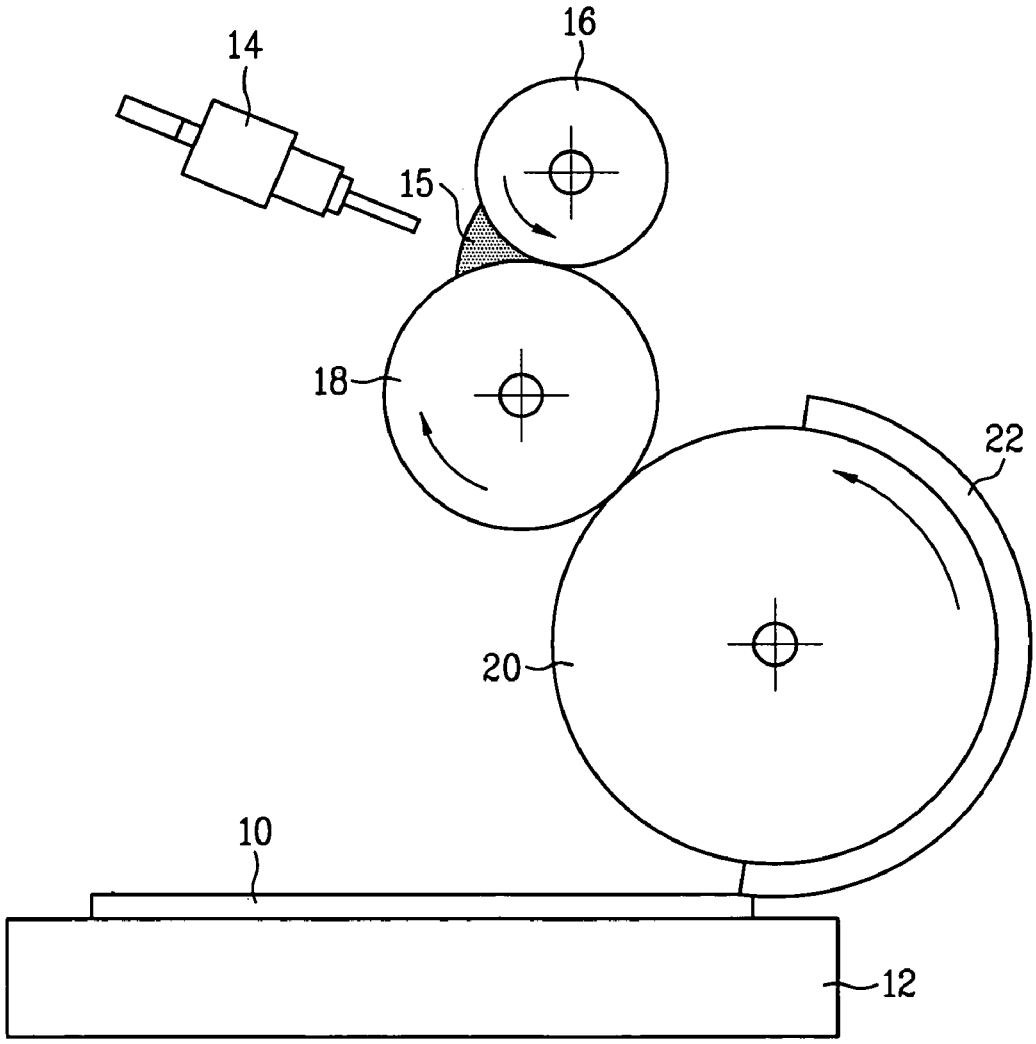
FIG. 1 Related Art
FIG. 1 illustrates a method for coating an alignment film with a related art roll printing device.
Figure 2:
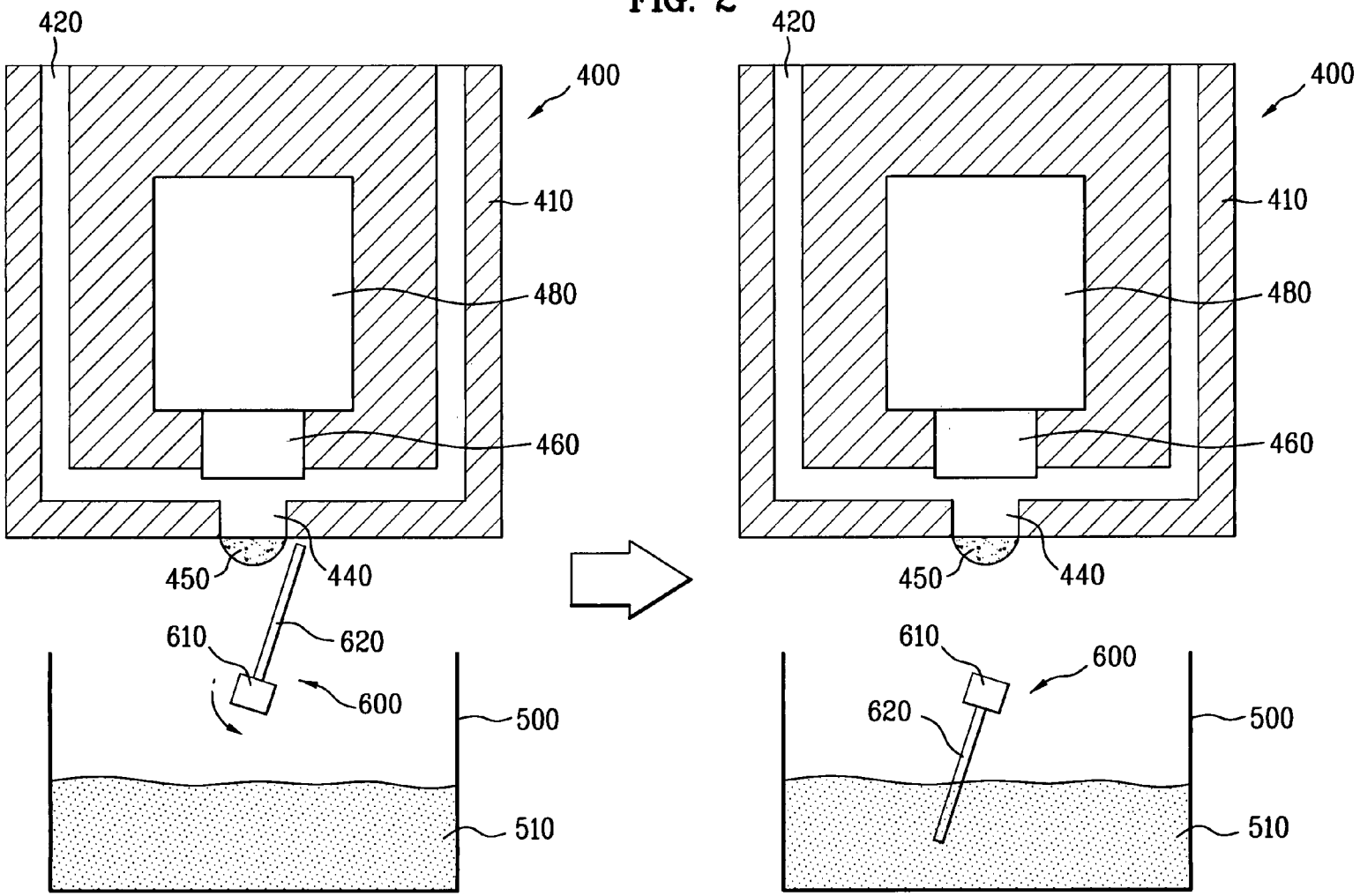
FIG. 2 illustrates a method for washing an inkjet head with a device for washing an inkjet head in accordance with a first embodiment of the present invention.

Referring to FIG. 2, the device for washing an inkjet head includes a bath 500 and a wiping device 600. The bath 500 holds washing solution 510 for washing a wiping device 600 which has cleaned an inkjet head 400. The wiping device 600 includes a holding portion 610 and a wiper 620. The holding portion 610 holds the wiper 620, and the wiper 620 removes alignment material 450 from a nozzle 440 of the inkjet head 400.

In this embodiment, the wiping device 600 can swing around the holding portion 610. That is, after removing the alignment material 450 from the nozzle 440 of the inkjet head 400, the wiping device 600 swings so that the wiper 620 dips into the washing solution 510 in the underlying bath 500 for washing.

Thus, the present invention permits easy removal of the alignment material 450 from the nozzle 440 of the inkjet head 400. Furthermore, as the wiping device 600 may swing, the wiping device 600 may repeatedly clean the inkjet head 400 after repeatedly washing the wiper 620.

In accordance with an embodiment of the present invention, the wiper 620 may be formed of an elastic material, such as rubber, for smooth removal of the alignment material 450. In this embodiment, the materials of the wiper 620 and the holding portion 610 differ from one another. Therefore, a separate structure is required for securing the wiper 620 to the holding portion 610, which will be described with reference to FIGS. 3A-3C.

Figure 3A:
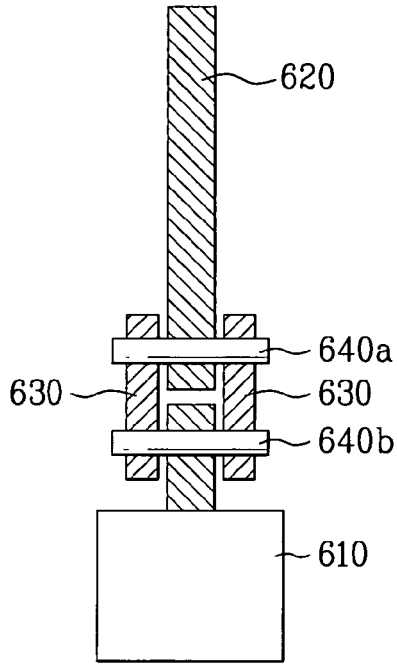
FIG. 3A is a sectional view of a wiping device assembly in a device for washing an inkjet head.
Figure 3B:
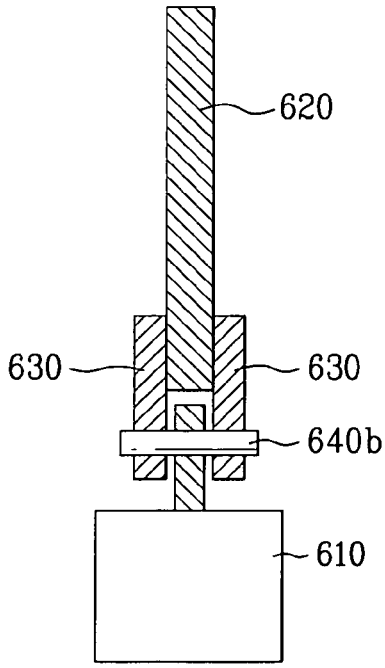
FIG. 3B is a sectional view of a wiping device assembly in a device for washing an inkjet head.
Figure 3C:
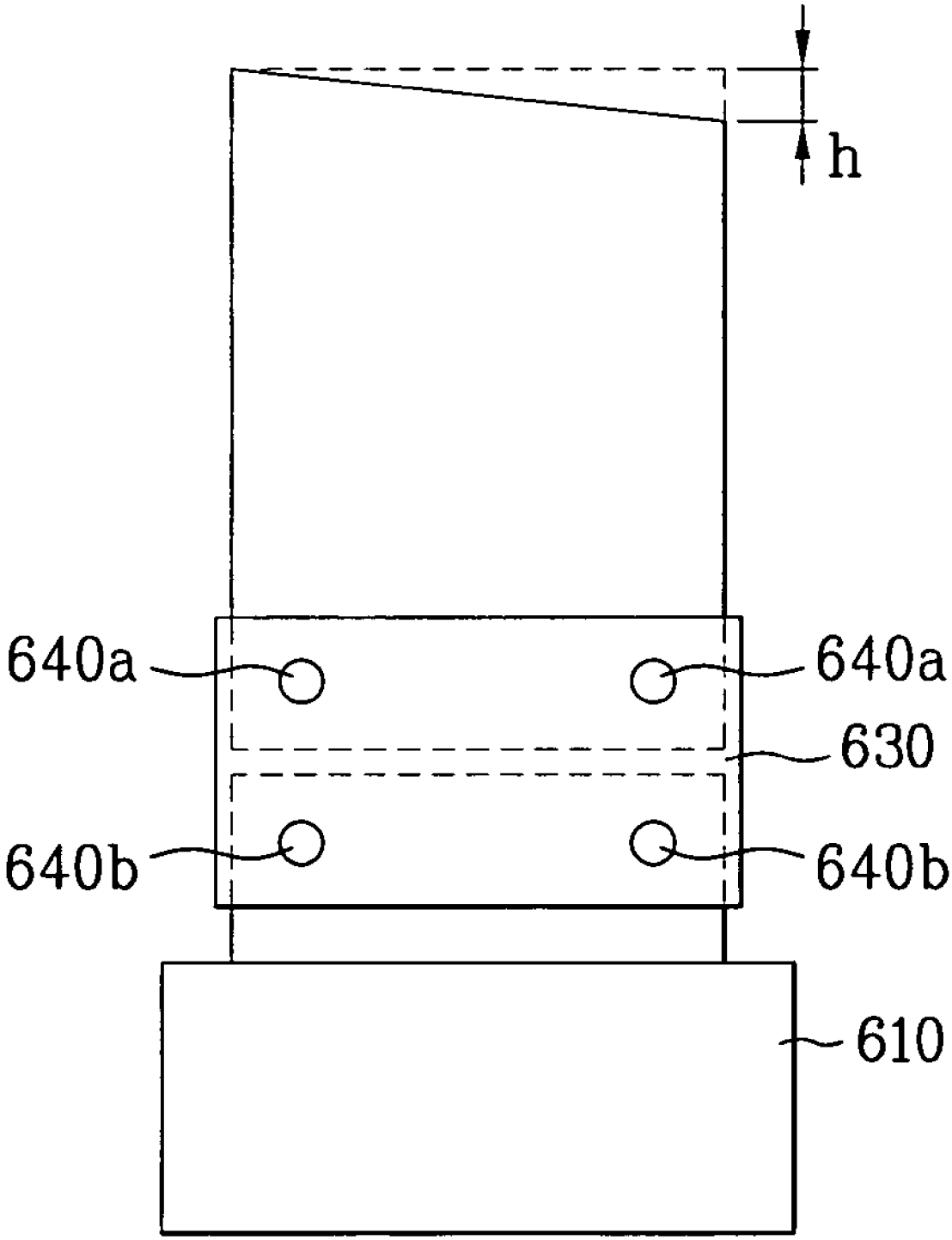
FIG. 3C shows a side view of a wiping device assembly in a device for washing an inkjet head.

FIGS. 3A-3C illustrate the wiper 620 secured to the holding portion 610 with a bracket 630. However, the bracket 630 is not necessarily required for securing the wiper 620.

As may be seen with reference to FIGS. 3A and 3C, in one embodiment, first bolts 640*a* secure the wiper 620 to the bracket 630. Second bolts 640*b* secure the bracket 630 to the holding portion 610, thereby securing the wiper 620 to the holding portion 610.

Now making reference to FIG. 3B, in an alternative embodiment, an adhesive attaches the wiper 620 to the bracket 630. In addition, the second bolts 640*b* fasten the bracket 630 to the holding portion 610, thereby securing the wiper 620 to the holding portion 610.

In an embodiment where the wiper 620 is formed of an elastic material, when the wiper 620 is fastened to the bracket 630 with the first bolts 640*a* as shown in FIG. 3A, a portion of the wiper 620 may contract during fastening to the bracket 630. The contraction may affect a flatness of the wiper 620 if no uniform distribution of force occurs at the first bolts 640*a* (i.e., there can be a height difference of 'h' as shown in FIG. 3C). Therefore, the wiper 620 may be attached to the bracket 630 with an adhesive as discussed with reference to FIG. 3B.

SECOND EMBODIMENT

Figure 4:
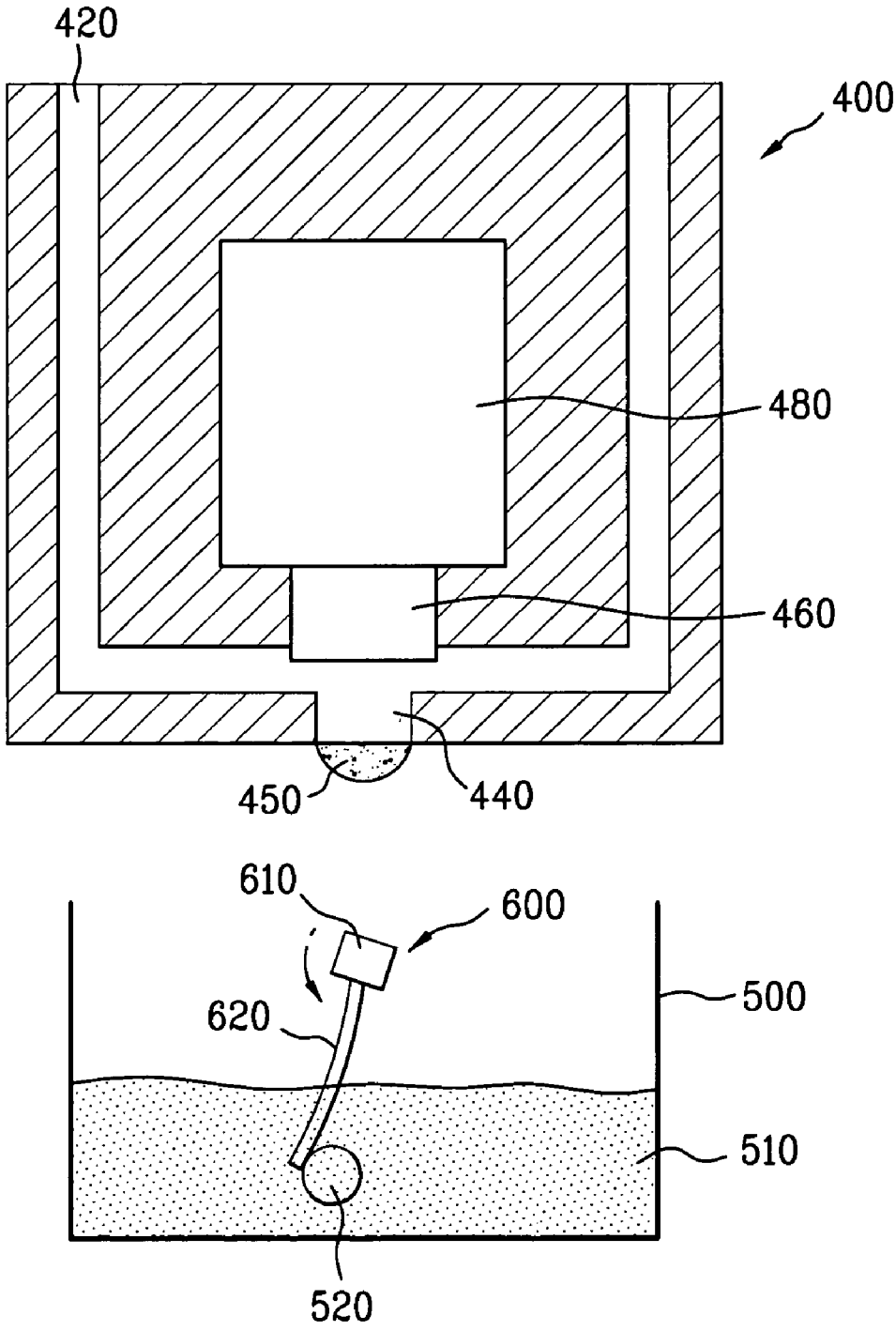
FIG. 4 illustrates a section of a device for washing an inkjet head in accordance with a second embodiment of the present invention.

FIG. 4 is a sectional view of a device for washing an inkjet head in accordance with a second embodiment of the present invention. In this embodiment, the inkjet head has a structure similar to that described with reference to FIG. 2. However, in this embodiment, the bath 500 has a bar 520 disposed therein. Therefore, similar parts have the same reference symbols and description of those parts will be omitted.

The bar 520 disposed in the bath 500 has a predetermined shape. In this embodiment, when the wiper 620 swings into the bath 500, the wiper 620 contacts the bar 520 such that any alignment material 450 disposed on the wiper 620 from the nozzle 420 is removed therefrom.

THIRD EMBODIMENT

Figure 5A:
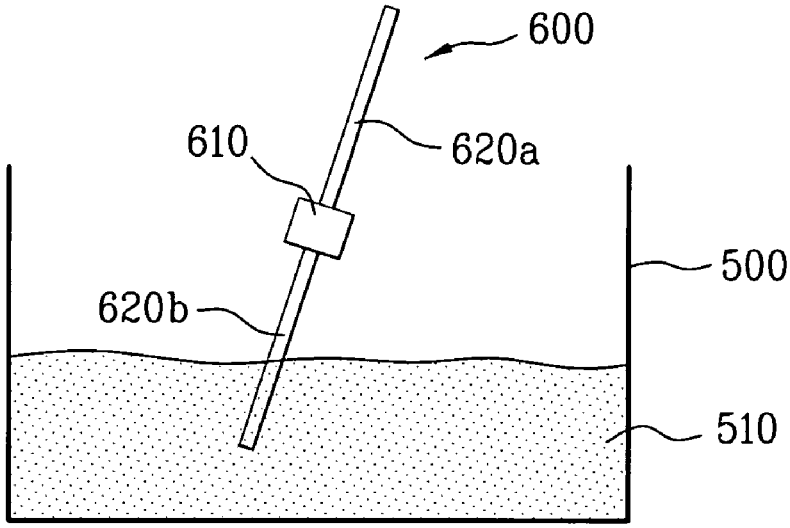
FIGS. 5A to 5C illustrate sections each showing a device for washing an inkjet head in accordance with a third embodiment of the present invention.
Figure 5B:
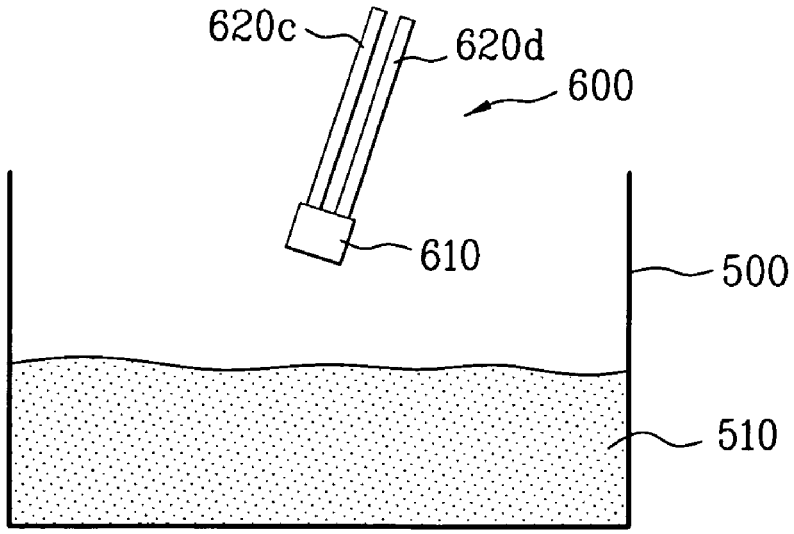
Figure 5C:
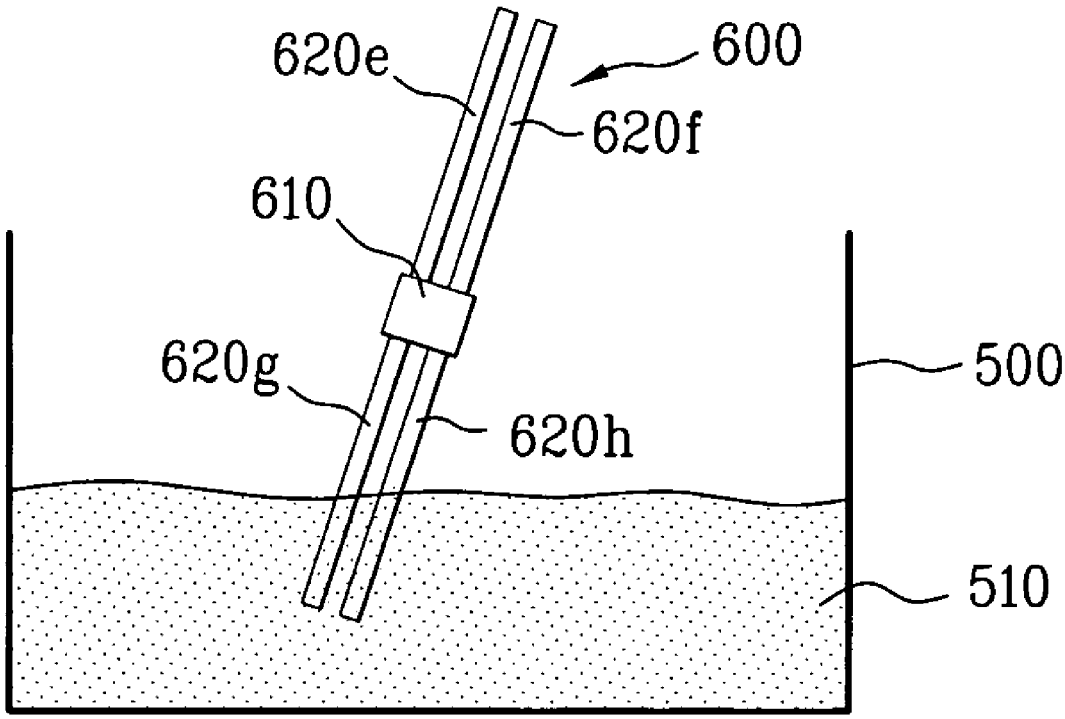

FIGS. 5A to 5C illustrate sections each showing a device for washing an inkjet head in accordance with a third embodiment of the present invention. In this embodiment, the inkjet head has a structure similar to that described with reference to FIG. 2. However, in this embodiment, the wiping device 600 has wipers 620*a* and 620*b*, as shown with reference to FIGS. 5A to 5C. Therefore, similar parts have the same reference symbols and description of those parts will be omitted.

FIG. 5A illustrates the wipers 620*a* and 620*b* secured to the holding portion 610. In this embodiment, the wipers 620*a* and 620*b* are disposed on opposite sides of the holding portion 610, as shown with reference to the FIG. 5A. Here, as the solution 510 cleans the wiper 620*b*, the wiper 620*a* removes alignment material from a nozzle. Similarly, when the solution 510 cleans the wiper 620*a*, the wiper 620*b* cleans alignment material from the nozzle.

FIG. 5B illustrates a pair of wipers 620*c* and 620*d* held at the holding portion 610. In this embodiment, the pair of wipers 620*c* and 620*d* are more efficient in cleaning alignment material from the inkjet head 400 when compared with cleaning alignment material from the inkjet head 400 with one wiper.

FIG. 5C is an embodiment of the present invention utilizing the embodiments described with referenced to FIG. 5A and FIG 5B. Here, the wiping device 600 includes wipers 620*e* through 620*h* where the wipers 620*e* and 620*f* are on one side of the holding portion 610 and the wipers 620*g* and 620*h* are on an opposite side of the holding portion 610. As may be appreciated, the dual pair configuration of this embodiment increases the cleaning efficiency of the wiping device 600, thereby improving fabrication processes which use the wiping device 600.

An Inkjet Printing System

Figure 6:
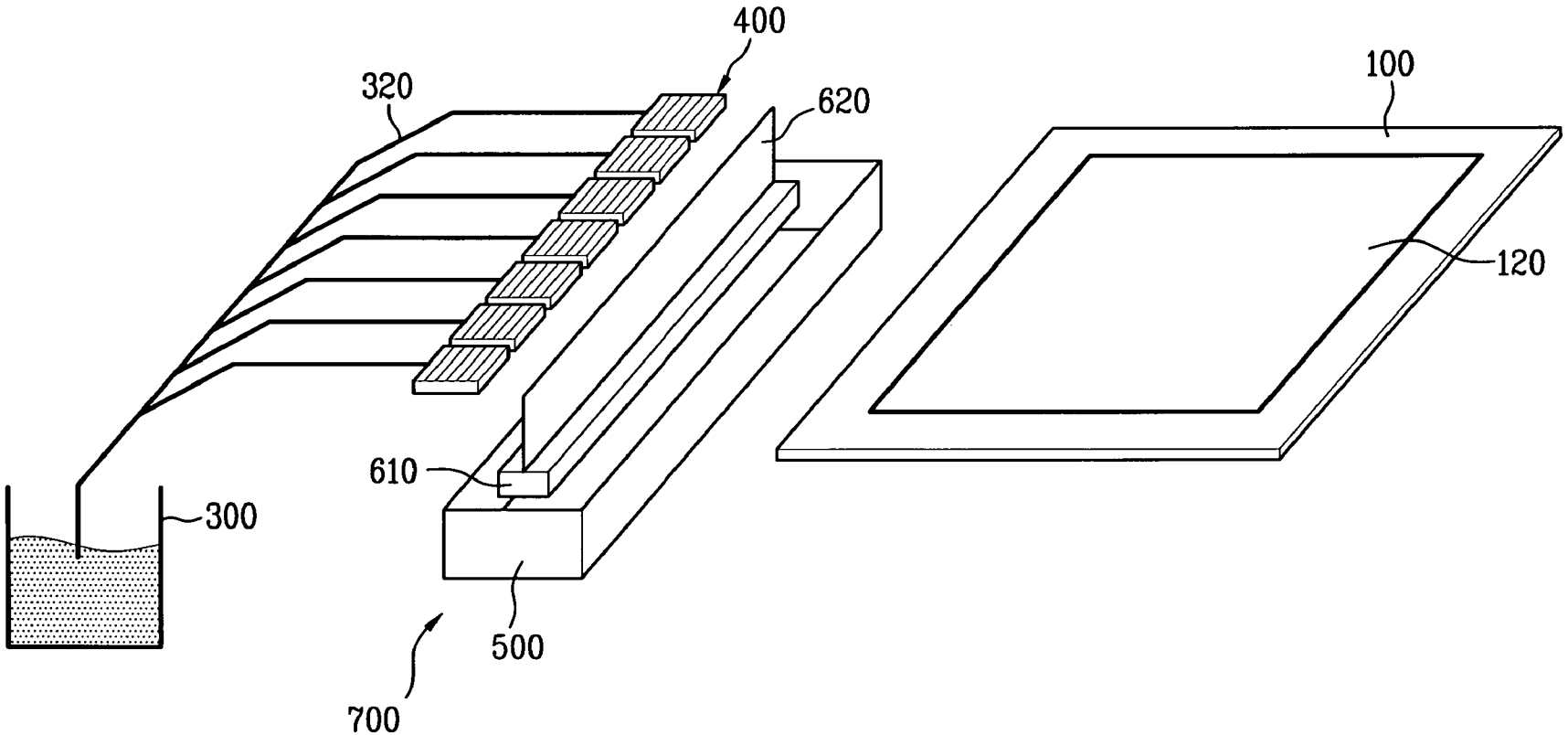
FIG. 6 illustrates a perspective view of an inkjet printing system in accordance with an embodiment of the present invention.

FIG. 6 illustrates a perspective view of an inkjet printing system in accordance with an embodiment of the present invention.

Referring to FIG. 6, an inkjet printing system 101 in accordance with an embodiment of the present invention includes a substrate stage 100, a supply tank 300, a plurality of heads 400, a pipe 320 between the supply tank 300 and the plurality of heads 400, and a head cleaning device 700.

In one embodiment, the substrate stage 100 is movable and supports the substrate 120.

The supply tank 300 holds a predetermined material, such as an alignment material. The pipe 320 supplies the predetermined material to the head 400. Though the inkjet printing system of the present invention may be used for forming an alignment film of a liquid crystal display device, the inkjet printing system described herein may be used in other applications. More specifically, the inkjet printing system may be used during the formation of other components of the liquid crystal display device. In addition, an inkjet printing system in accordance with present invention may be used for other display devices other than a liquid crystal display device. Accordingly, the predetermined material held in the supply tank 300 may vary according to the type of component formed on a liquid crystal display device or the type of display device being formed.

The plurality of heads 400 may be formed according to a size of the substrate. Furthermore, the plurality of heads may be movable in a predetermined direction.

The head will be described in more detail with reference to FIG. 2.

Referring to FIG. 2, the head 400 includes a head body 410, a supply pipe 420, a nozzle 440, a piezoelectric transducer 460, and a voltage applying device 480.

Though FIG. 2 shows only one nozzle 440, a plurality of nozzles may be formed on one head. If a plurality of nozzles are formed on one head, a plurality of the supply pipes 420, the piezoelectric transducers 460, and the voltage applying devices 480 are also provided.

The supply pipe 420 allows for the passage of the predetermined material, such as alignment material, into the head 400.

The nozzle 440 is connected to a predetermined portion of the supply pipe 420. The nozzle 440 discharges the predetermined material from the head 400.

The piezoelectric transducer 460 is disposed opposite to the nozzle 440 at an opposite side of the supply pipe 420. When a voltage is applied to the piezoelectric transducer 460, the piezoelectric transducer deforms, thereby squeezing the supply pipe 420. When the supply pipe 420 is squeezed, the supply pipe 420 discharges the predetermined material into the nozzle 440 and out of the head 400.

The piezoelectric transducer has a piezoelectric phenomenon, in which positive and negative charges are generated at opposite sides of a certain kind of crystalline plate. The generated charges are proportional to an external force applied to the plate in a fixed direction. This phenomenon was discovered in 1880 by brothers of Jacque Curie and Pierre Curie (1859~1906). Thereafter, it was discovered that, though piezoelectricity from one crystalline plate is feeble, if a plurality of crystalline plates are put together with a sheet of metal foil placed therebetween, a quantity of the piezoelectricity is significantly increased. Furthermore, a crystalline plate has a natural frequency, and when an elastic vibration and an electric vibration resonate, a more intense vibration is generated in association with the piezoelectricity.

What is devised by using such a phenomenon for application to various fields is the piezoelectric transducer, made from either quartz, tourmaline, Rochelle salt, or so on. Additionally, artificial crystals, such as barium titanate, ammonium dihydrogen phosphate, and ethylencediamine tartarate, may be used as a material of the piezoelectric transducer due to their favorable piezoelectric properties.

The voltage applying device 480 is connected to the piezoelectric transducer 460 for application of voltage to the piezoelectric transducer 460. In accordance with an embodiment of the present invention, the piezoelectric transducer 460 and the voltage applying device 480 form a discharger.

The head washing device 700 includes the bath 500, the holding portion 610, and the wiper 620, which is similar to the previously discussed embodiment. As such, description of which will be omitted.

The head washing device 700 may be positioned in front of the substrate stage 100 for coating the predetermined material on the substrate 100 after the head 400 is washed. In addition, the head washing device 700 may be positioned behind the substrate stage 100. Moreover, the head washing device 700 may be attached to the substrate stage 100.

As described above, a device for washing an inkjet head of the present invention has the following advantages. The use of a wiping device having an elastic wiper secured to a holding portion permits easy removal of alignment material and the like from a nozzle of an inkjet head. Furthermore, since the wiping device is rotatably mounted, the wiper may be easily washed with washing solution in a bath after the wiper removes alignment material from a nozzle of an inkjet head.

The use of a bar in the bath further improves washing of the wiper since the wiper rubs against the bar.

The provision of a plurality of wipers held by the supporting portion improves the washing capability of the inkjet head, and increases overall efficiency of the fabrication process which uses the wiping device of the present invention.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An inkjet printing system comprising:

a substrate stage which supports a substrate;

a supply tank, the supply tank holding a material;

a head for discharging the material;

a pipe connected between the supply tank and the head; and a washing device, the washing device comprising:

a bath, the bath holding washing solution therein;

a bar disposed within the bath and soaked in the washing solution; and a wiping device positioned above the bath, wherein the wiping device includes a holding portion and an elastic wiper held at the holding portion and rotatable relative to the holding portion, wherein the wiper contacts the bar in the washing solution when the wiper rotates for cleaning.

2. The system as claimed in claim 1, wherein the wiper is formed of rubber.

3. The system as claimed in claim 1, wherein a bracket couples the wiper with the holding portion.

4. The system as claimed in claim 3, wherein bolts couple the bracket with the holding portion.

5. The system as claimed in claim 3, wherein bolts couple the bracket with the wiper.

6. The system as claimed in claim 3, wherein an adhesive couples the bracket with the wiper.

7. The system as claimed in claim 1, wherein a plurality of wipers are held at the holding portion.

8. The system as claimed in claim 7, wherein a first wiper of the plurality of wipers is disposed at a first side of the holding portion and a second wiper of the plurality of wipers is disposed at a second side of the holding portion opposite the first side.

9. The system as claimed in claim 7, wherein a pair of the plurality of wipers are disposed on a same side of the holding portion.

10. The system as claimed in claim 1, wherein the substrate stage is movable.

11. The system as claimed in claim 1, wherein the head includes:

a head body;

a supply pipe disposed in the head body, the supply pipe being configured to allow passage of the material through the head body;

a nozzle in fluid communication with the supply pipe, the nozzle being configured to discharge the material from the head; and a discharger configured to discharge the material through the nozzle and out of the head.

12. The system as claimed in claim 11, wherein the discharger includes:

a piezoelectric transducer disposed opposite the nozzle with respect to the supply pipe; and a voltage applying device operatively coupled with the piezoelectric transducer, wherein the voltage applying device applies a voltage to the piezoelectric transducer.

13. The system as claimed in claim 11, wherein the head body includes a plurality of supply pipes, a plurality of nozzles, and a plurality of the dischargers.

14. The system as claimed in claim 1, further comprising: a plurality of heads.

15. The system as claimed in claim 1, wherein the washing device is disposed in front of the substrate stage.

16. The system as claimed in claim 1, wherein the head is movable.

* * * * *